US005499740A

United States Patent [19]

Huck et al.

[11] Patent Number: 5,499,740

[45] Date of Patent: Mar. 19, 1996

[54] CONTAINER AND METHOD FOR DISPENSING SEALED ARTICLES

[76] Inventors: Mark M. Huck, 231 26th Ave. East, Seattle, Wash. 98112; Irene E. Barbieri, 3073 S. Abingdon St., Arlington, Va. 22206

[21] Appl. No.: 430,237

[22] Filed: Apr. 28, 1995

Related U.S. Application Data

[63] Continuation-in-part of Ser. No. 189,493, Jan. 31, 1994, Pat. No. 5,435,459.

[51] Int. Cl.[6] ..... B65H 5/28

[52] U.S. Cl. ..... 221/70; 221/89; 206/440

[58] Field of Search ..... 221/70, 89, 90, 221/25, 47, 48, 268; 206/440, 438, 828, 804

[56] References Cited

U.S. PATENT DOCUMENTS 2,409,362 10/1946 Kleinmann ..... 221/70

4,913,311 4/1990 Garcia ..... 221/25

*Primary Examiner*—Kenneth Noland

*Attorney, Agent, or Firm*—Corinne R. Gorski

[57] ABSTRACT

A dispensing apparatus including at least one package having a bottom and at least one opening. A plurality of wrapped articles are disposed within the package. Each of the wrapped articles have a first and second end. A pull-tab is attached to the first end of each of the wrapped articles. An elongated tab having opposed ends is attached at one end to the second end of one of each of the wrapped articles and the other end of each of the elongated tabs is attached to the bottom of the package, wherein when the pull-tab is pulled outwardly the respective article unwraps and is dispensed through the opening of the package. The dispenser, therefore, is capable of delivering and unwrapping an article to the user in a convenient, easy, economical manner.

19 Claims, 13 Drawing Sheets

CONTAINER AND METHOD FOR DISPENSING SEALED ARTICLES

This is a continuation-in-part of allowed U.S. patent application Ser. No. 08/189,493, filed on Jan. 31, 1994 now U.S. Pat. No. 5,435,459.

BACKGROUND OF THE INVENTION

1. Field of the Invention

The present invention relates to article dispensers, particularly to such dispensers designed to dispense by stripping off surface adhered articles.

2. Description of Related Art

Commonly, dispensers are designed to deliver individually wrapped or unwrapped articles to the user. Such dispensers have been designed and used in the following ways; by consumers to organize and dispense personal items, such as medications; by businesses to deliver products to customers; and by manufacturers to contain and dispense materials needed in the manufacturing process. However, none of these dispensers can unwrap an individual article during the process of dispensing the article.

In the case of wrapped articles, inventors have created several types of dispensers. U.S. Pat. No. 5,007,540 to Beasley et al. discloses a package of multiple dispensers. However, the articles are not unwrapped as part of the dispensing process.

The prior art does not show a wrapper that works in conjunction with a dispenser to unwrap the article as it is dispensed. U.S. Pat. No. 3,652,006 to Trewella discloses a wrapper that can be easily peeled apart by the user. However, Trewella does not describe a wrapper, mechanism or method whereby a wrapped article is removed from its wrapping while being dispensed.

Neither the dispensers or wrappers described above describe the release of an article from its individual wrapper as the user pulls the wrapped article from the dispenser. Nor, do the prior art dispensers show a wrapper that is attached to a dispenser in such a manner that the wrapped item is ejected from the wrapper as the user removes the wrapper from the dispenser.

The prior art does not teach a dispenser which economically enhances the speed and ease with which a sealed article is delivered to the user—attributes which would facilitate and/or encourage the use of the article.

Two examples are illustrative. First, convenient and easy access to dean medical products in a doctor's office or emergency room frequently is hampered by current methods and designs for storing and dispensing products such as sutures, bandages, and other wrapped articles. Currently, most sutures and bandages are packaged in boxes. The user must search for the box and then for the individual item before even opening the item's sterile wrapper. The boxes are generally stored in drawers, cabinets or shelves. However, in a medical emergency, the need for fast, efficient dispensing of articles can be critical to positive outcomes of treatment.

The present invention obviates all these inconveniences and inefficiencies. Medical workers would find greater access to and improved ease-of-use for various wrapped products through use of the dispenser described by the present invention.

Second, increased ease and more frequent use of certain articles such as condoms by users could reap substantial social benefits if a dispenser is available to unwrap and dispense the article. For example, the federal government now openly promotes the use of condoms to avert the spread of the AIDS virus and other sexually transmitted diseases. However, as currently packaged and dispensed, condoms are inconvenient and difficult to use. People are likely to store the condoms in purses, wallets, bathroom cabinets, under the bed, and in many other inconvenient places. This discourages use at a time when the condom is actually needed. If the condom is not readily accessible, the likelihood of its use diminishes. More specifically, male condoms are often packaged in individual wrappers which are joined together using perforations between the wrappers. The user must therefore undertake, usually in a poorly-lit (night-time) environment; the following steps to use the condom: 1) locate the condom, 2) separate a wrapped condom from the other wrapped condoms, 3) tear open a wrapped condom, and 4) determine how to position the condom so that it unrolls properly. Each of these steps, inconvenient and frustrating to the user, is remedied by the present invention.

All dispensers heretofore known suffer from the disadvantages that once dispensed, the wrapped articles must still be unwrapped by the user, adding frustration or error if time is of the essence to the user. A problem which is compounded if multiple dispensings are necessary in a short period of time. Moreover, if the user is wearing latex gloves, the difficulty is further aggravated.

SUMMARY OF THE INVENTION

The present invention overcomes the deficiencies of the prior art by providing a dispensing apparatus which is uniquely designed to organize and dispense individual articles conveniently, quickly, safely, and economically. Articles that the dispenser is well suited to dispense include bandages, sutures, condoms, surgical gloves, and electronic or other small parts—where cleanliness, convenience and safety are important considerations.

The dispensing apparatus of the present invention comprises at least one package having a bottom and at least one opening. A plurality of wrapped articles are disposed within the package. Each of the wrapped articles has a first and a second end. A plurality of pull-tabs are each attached to the first end of each of the respective wrapped articles. A plurality of elongated tabs, each having opposed ends, are each attached to the second end of one of each of said wrapped articles and the other end of each of the plurality of elongated tabs to the bottom of the package, wherein when the pull-tab is pulled outwardly the respective article unwraps and is dispensed through the opening of the package.

One advantage of the dispensing apparatus of the present invention is that the user may easily and flexibly locate, mount, color-code the pull-tabs and label the package, adding to the ease and convenience of dispensing the articles.

The present invention also permits sterile sutures or gauze bandages to be dispensed free from their wrappers, thereby allowing quicker use of the items in emergency situations. Moreover, the dispensers for these items can be easily mounted on a wall or the underside of a cabinet, improving accessibility to the items.

Other features and advantages of the present invention will become apparent from the following description of the invention which refers to the accompanying drawings.

DETAILED DESCRIPTION OF THE PREFERRED EMBODIMENTS

Figure 1:
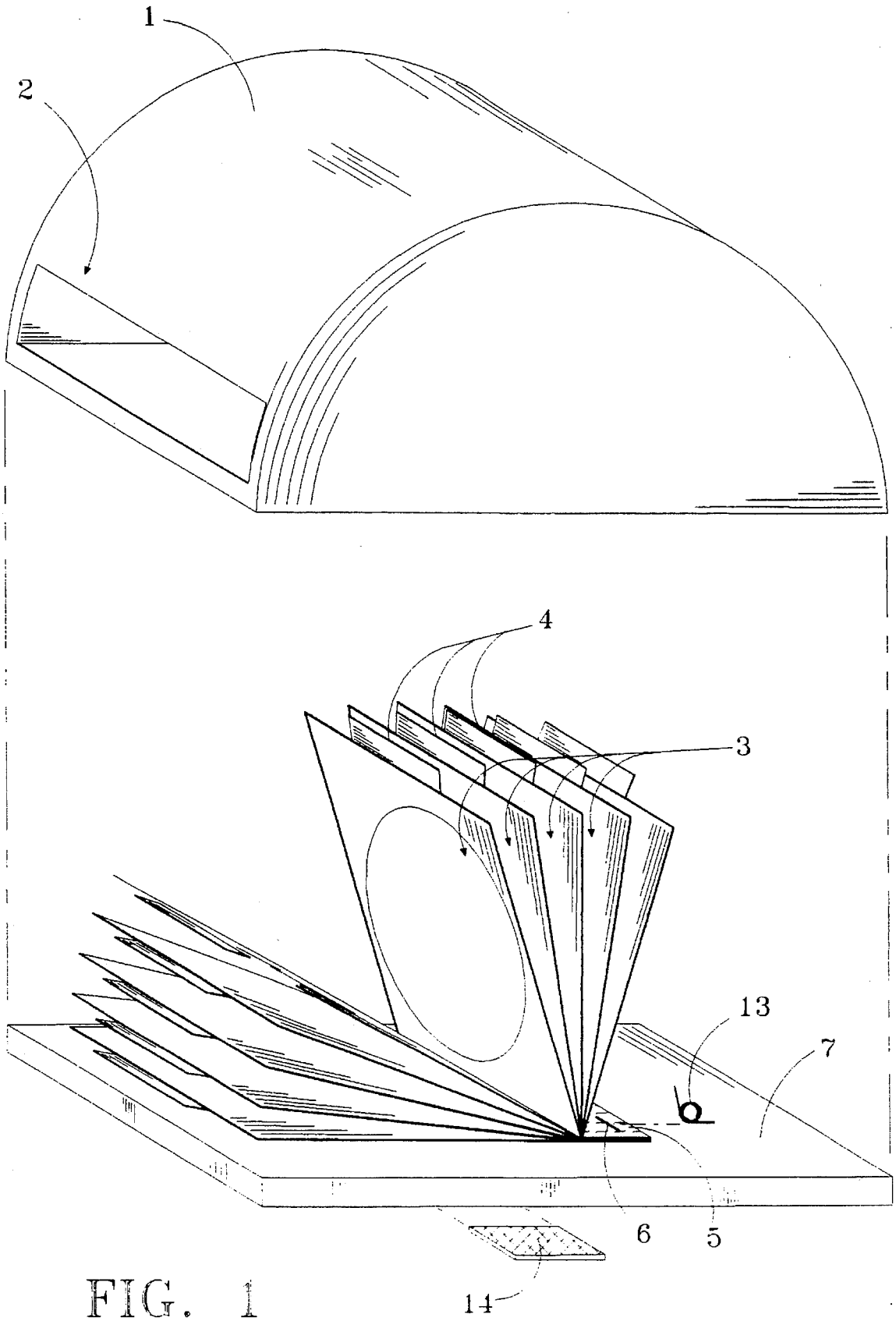
FIG. 1 is a perspective view of one embodiment of the dispensing apparatus of the present invention.
Figure 2:
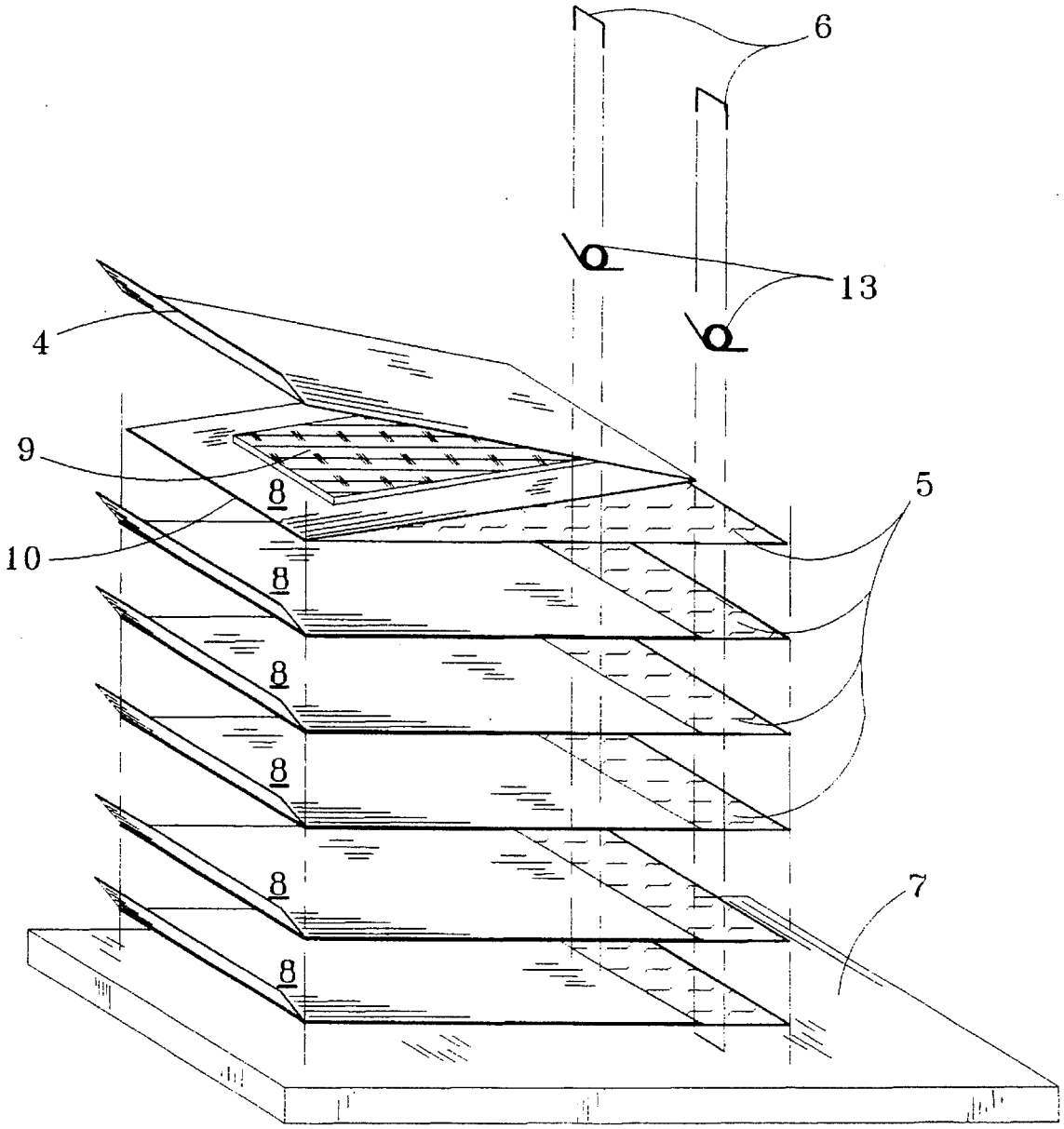
FIG. 2 is a perspective detailed view illustrating the wrapped articles fastened to the dispenser.

A first embodiment of the invention is illustrated in FIGS. 1 and 2. The dispenser includes an outer cover or casing 1 and a platform 7. A plurality of articles 3 to be dispensed are fastened on platform 7. Each wrapped article 3 includes an elongated tab 5 at one end. The tabs 5 are attached to platform 7. A fastener 6 attaches tabs 5 to platform 7, however, a variety of different attachment schemes, for example, adhesive, can be used to attach tabs 5 to platform 7.

Each of the wrapped articles includes a pull tab 4 located on a second end of the article, which will be described further herein. Pull tabs 4 are visible to the user through an opening 2 in casing 1. The dispenser may be mounted to a wall or other surface using the mounting bracket or adhesive surface 14.

FIG. 2 shows a detail of how the wrapper is sealed and then attached to the dispenser. An article 9 is wrapped in a tear-open sealed wrapper 8. Elongated tab 5 attaches to the sealed wrapper on the side of the wrapper opposite the side containing the pull-tab 4. Pull-tab 4 is attached to wrapper 8 via a perforation 10. As described above, the free end of the elongated tab 5, i.e., the end not attached to the sealed wrapper—is affixed to the dispenser surface using fastener 6. To aid in dispensing, a coil spring 13 attached to platform 7, can be used to bias the wrapped articles 8 toward casing opening 2.

Figure 3A:
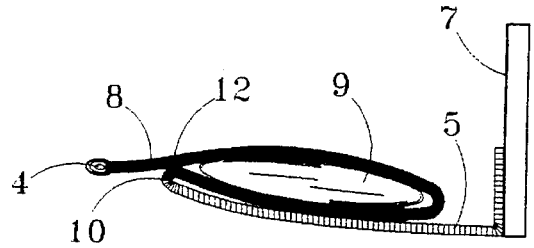
FIGS. 3A through 3E illustrate the method of removing articles from the dispenser in which the wrapper is opened during the process of dispensing.
Figure 3B:
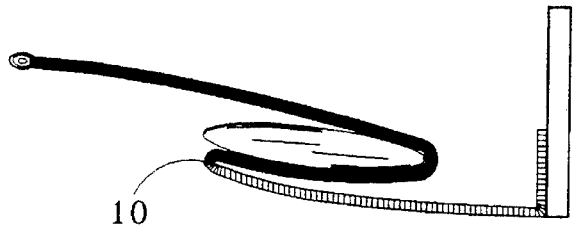
Figure 3C:
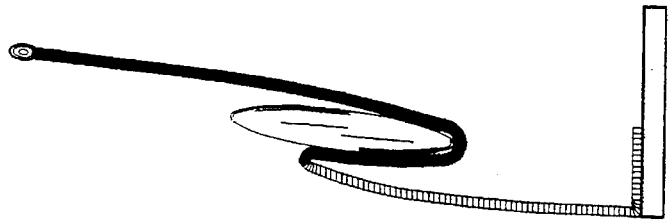
Figure 3D:
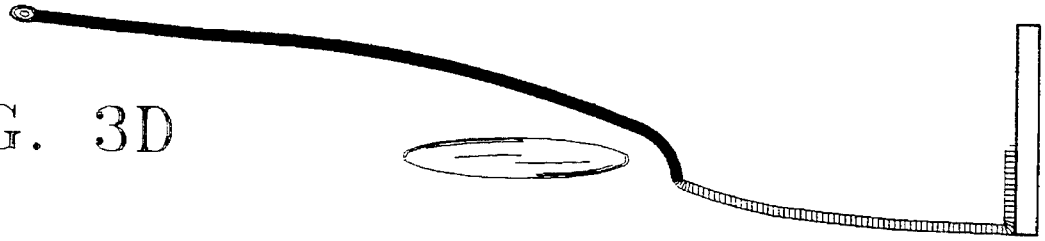
Figure 3E:
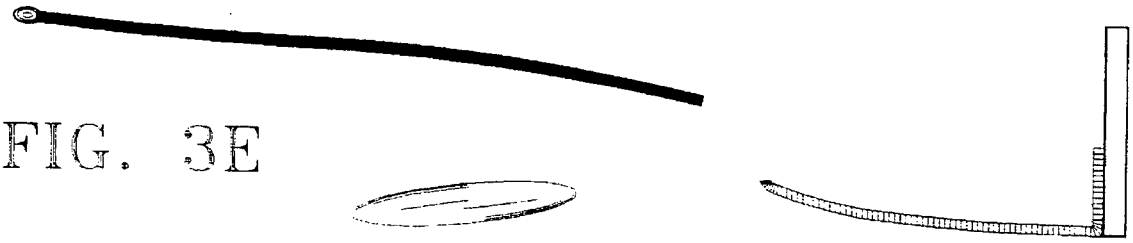

The operation of the invention is described with reference to FIGS. 3A through 3E. Article 9 has previously been packaged in a tear-open sealed wrapper 8 which is attached at perforation 10 to elongated tab 5, the free end of which is affixed to the dispenser platform 7. When the article 9 is needed, the user grasps pull-tab 4, pulling it away and out of the dispenser. As the wrapper 8 is pulled from the container, the elongated tab 5 stays affixed to the dispenser platform 7, causing the seal to tear on the sealed edge 12 nearest the pull-tab 4. As the user continues to pub the pull-tab away from the dispenser, the wrapper's seal breaks or tears, freeing the article 9 from the wrapper (FIG. 3C). The article 9 is exposed or falls free (FIG. 3D) as the tear-open wrapper 8 breaks from elongated tab 5 at perforation 10 (FIG. 3E). Perforation 10 allows the user to remove the excess wrapper 8 from the dispenser, if desired.

Figure 4:
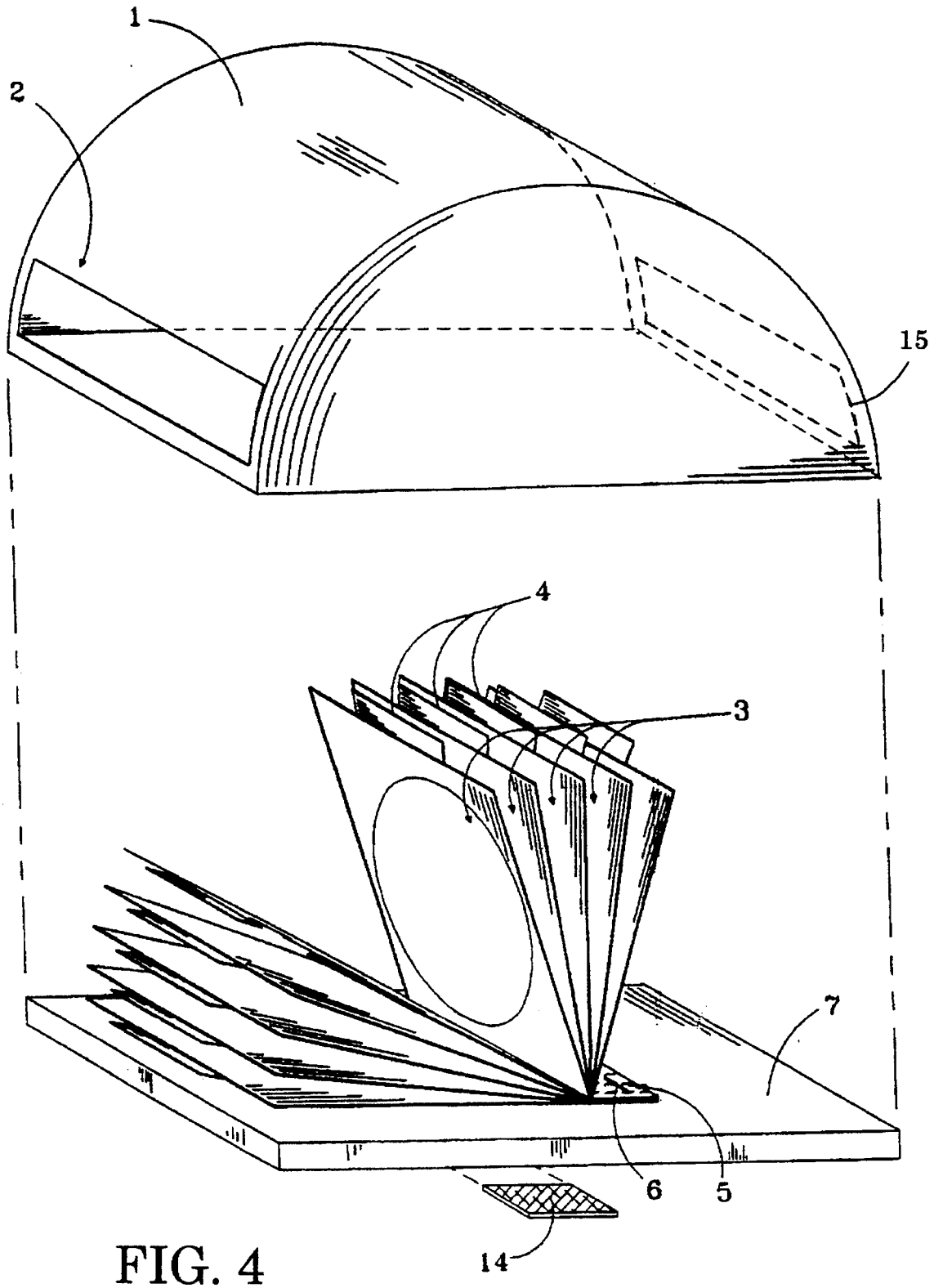
FIG. 4 is a perspective view of another embodiment of the invention, wherein the dispenser includes a plurality of openings for dispensing the articles.

FIG. 4 illustrates casing 1 having a plurality of openings 2, 15 such that the articles can be dispensed from different areas of the dispenser. It should be appreciated that means for biasing the wrappers towards the various openings, as discussed above, can also be used for this embodiment.

Figure 5:
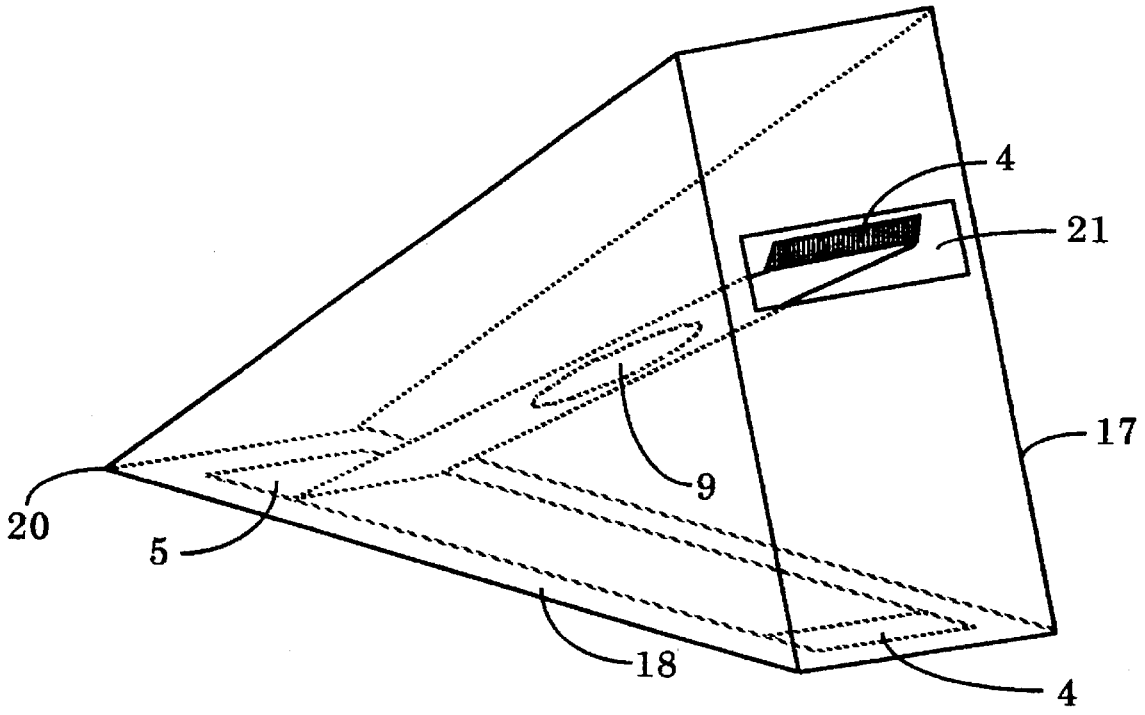
FIG. 5 illustrates a third embodiment of the invention, wherein the dispenser is wedged-shaped.

As shown in FIG. 5, the dispensing apparatus can have a wedge-shaped casing 17. In this embodiment, the elongated tabs 5 are attached to a platform 18 at the narrow end 20 of the casing and the articles are dispensed through an opening 21 in a wider end 22.

Figure 6:
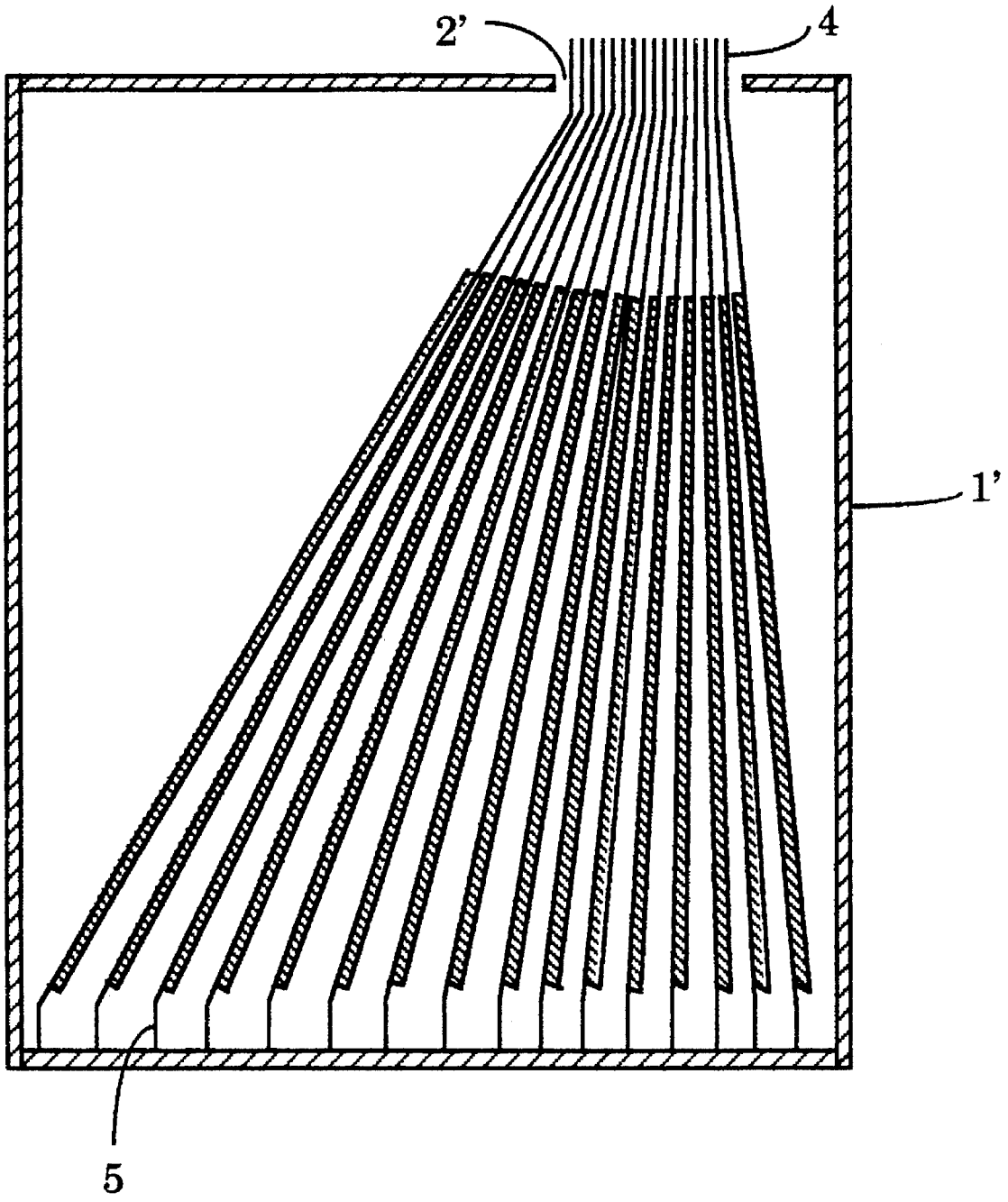
FIG. 6 illustrate still another embodiment of the invention, wherein only the pull-tabs are visible to the user.

As shown in FIG. 6, according to another embodiment of the invention, only the pull-tabs 4 are visible through an opening 2' in casing 1'. As shown, tabs 4 can be enlarged to extend through opening 2' by a substantial distance to enable the user to adequately grasp the tabs.

Figure 7:
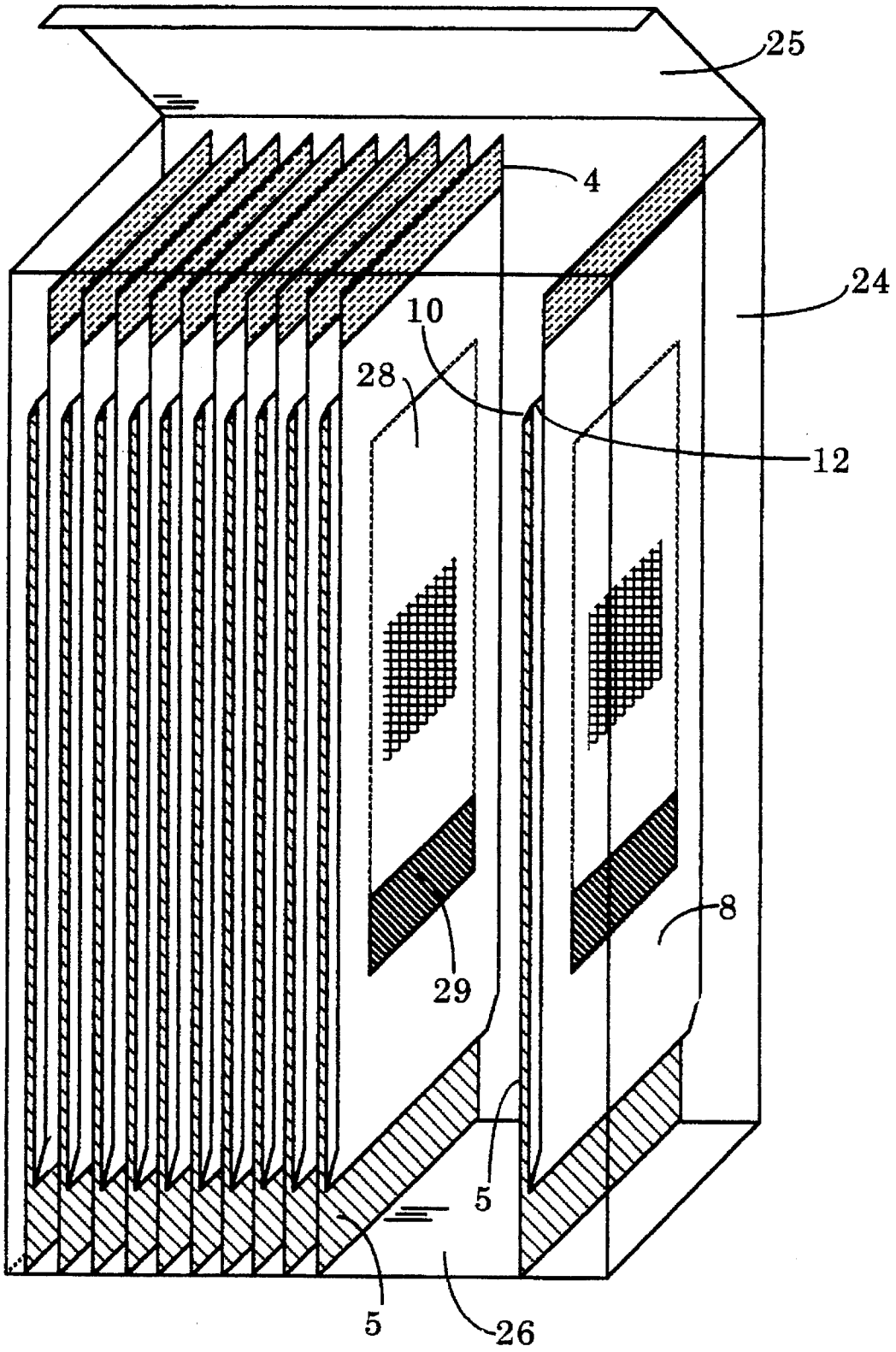
FIG. 7 is a perspective view of a fifth embodiment of the dispensing apparatus of the present invention.
Figure 8:
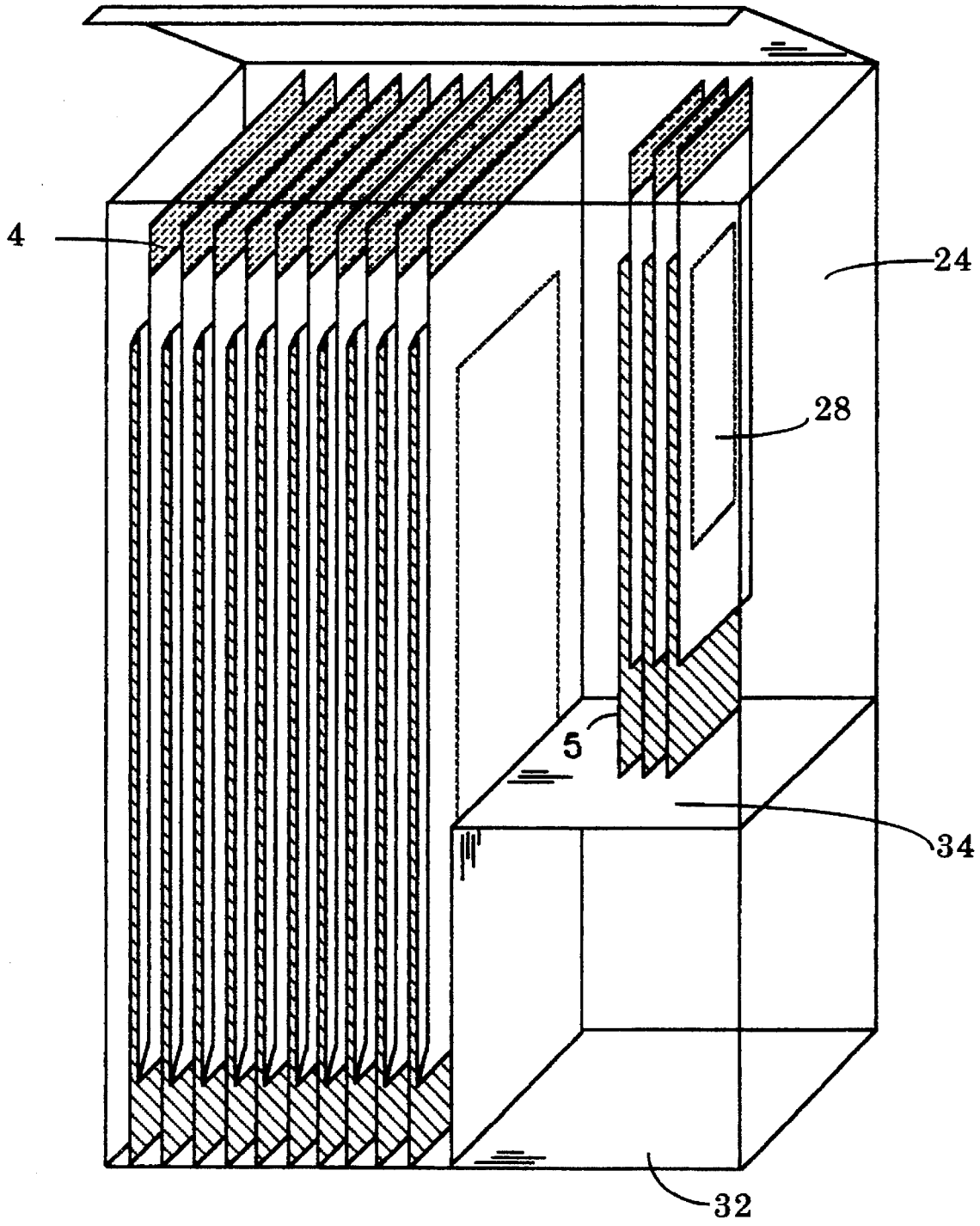
FIG. 8 is another embodiment of the bandage dispensing apparatus according to the present invention.
Figure 9:
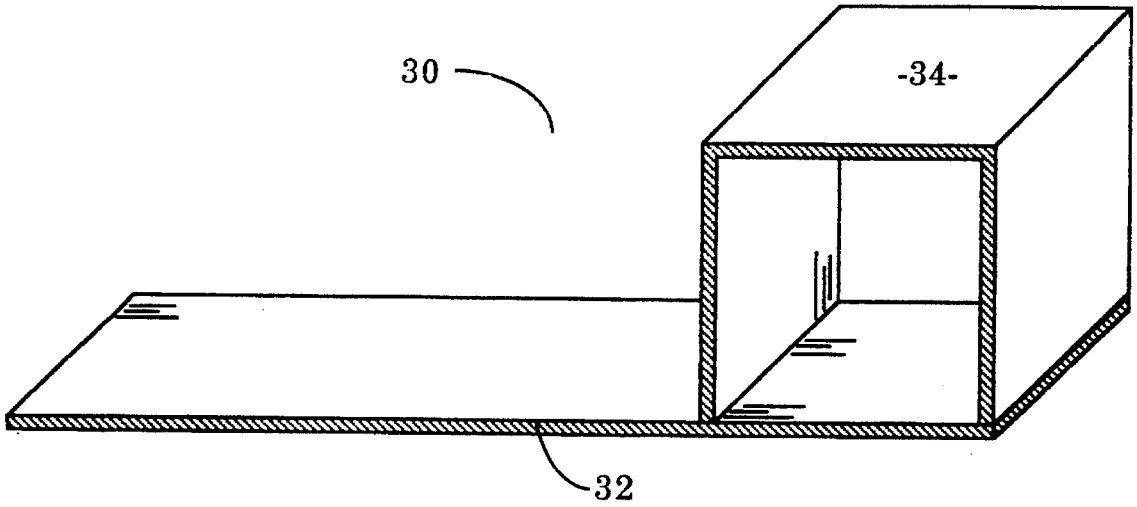
FIG. 9 is a perspective view of the platform incorporated in the bandage dispenser of FIG. 8.

Referring now to FIGS. 7–9, the dispensing apparatus of the present invention can dispense a plurality of bandages, such as adhesive strips. In this embodiment, the adhesive strips are enclosed within a package 24 having a flip-open top 25. The embodiment of FIGS. 7–9 operates in a similar manner to the embodiment of FIGS. 1–3E.

Elongated tabs 5 are attached to a bottom 26 of package 24. Tabs 5 can be attached to bottom 26 by a plurality of different fastening means. For example, hot glue or another adhesive, can be spread on bottom 26 prior to inserting the articles. The elongated tabs 5 can then adhere to the adhesive after being positioned within the package.

Like the first embodiment, a first aid strip 28 is wrapped in a tear-open sealed wrapper 8 which is attached to tab 5 at perforation 10. However, the first aid strip is adhered directly to the inside surface of the wrapper 8, which will be described further herein. Thus, when the user pulls on tab 4, seal 12 will be broken and wrapper 8 and strip 28 can be pulled from the package 24. Next, the user in a one-hand operation can grasp an adhesive-free section 29 of strip 28 and remove the same from wrapper 8 and place the strip on the wound.

In order to accommodate different sized bandages, a platform 30 can be placed within package 24. As shown in FIGS. 8 and 9, platform 30 includes a base 32 which has the same dimensions as the bottom 26 of package 24. One side of the base 32 can be folded upwardly to form an upraised step 34 upon which smaller sized bandages can be supported, as shown in FIG. 8. The elongated tabs of the larger sized bandages are adhered to base 32, while the elongated tabs of the smaller sized bandages are adhered to step 34.

When incorporating different sized bandages in a single package, the pull-tabs 4 can be color-coded to correspond to the size of the article inside the wrapper. Thus, the user can identify the bandage prior to dispensing.

Figure 10:
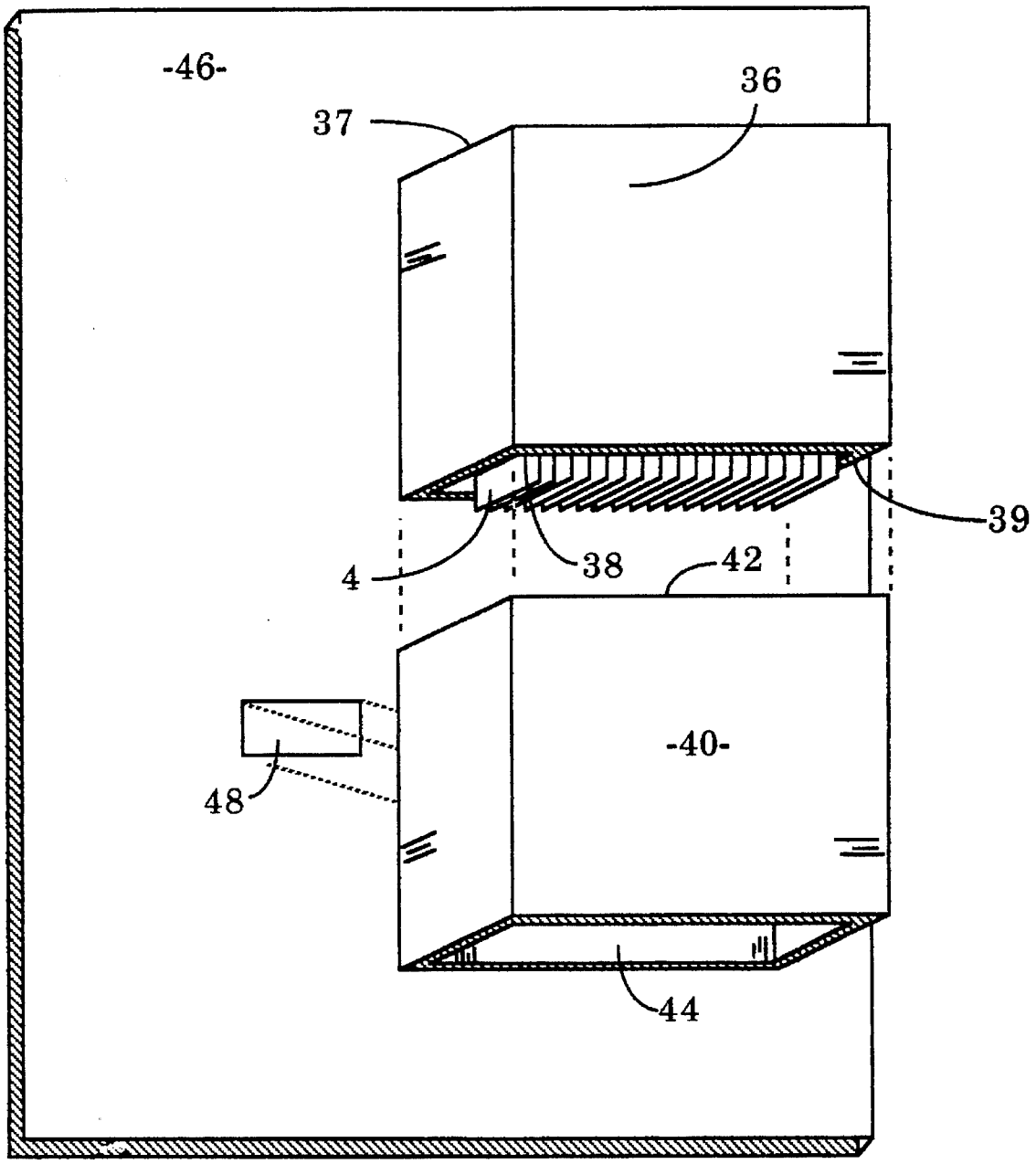
FIG. 10 illustrates a seventh embodiment of the invention, wherein the dispensing apparatus of the present invention is a refillable pack used with a dispenser.

FIG. 10 illustrates another embodiment of the present invention. As shown in FIG. 10, the dispensing apparatus can comprise a disposable refill package 36. As with the other embodiments, the elongated tabs (not shown) of the wrapped articles are attached to the top 37 of the package 38, and the pull-tabs 4 extend from opening 38. Although it is illustrated and described with the elongated tabs being adhered to the top of the package and the opening of the package being at the bottom, it should be appreciated that the opening can be in any of the sides or portions of the package, with the elongated tabs being adhered to the surface opposite the opening.

Package 36 is received within a dispenser 40 which is attached to a surface 46, such as a wall, via attachment means 48. Dispenser 40 can be made of any durable material, for example, plastic or cardboard. Attachment means 48 can be for example, a bracket, Velcro®, or adhesive. Dispenser 40 has an open top 42 for receiving refill package 36 and an open bottom 44. When received within dispenser 40, tabs 4 extend outwardly from opening 44, such that the user can easily grasp and pull the tab to dispense the article, as previously described herein. Around opening 44 is a lip 45 which engages an edge 39 of package 36 to retain the same within dispenser 40.

Figure 11:
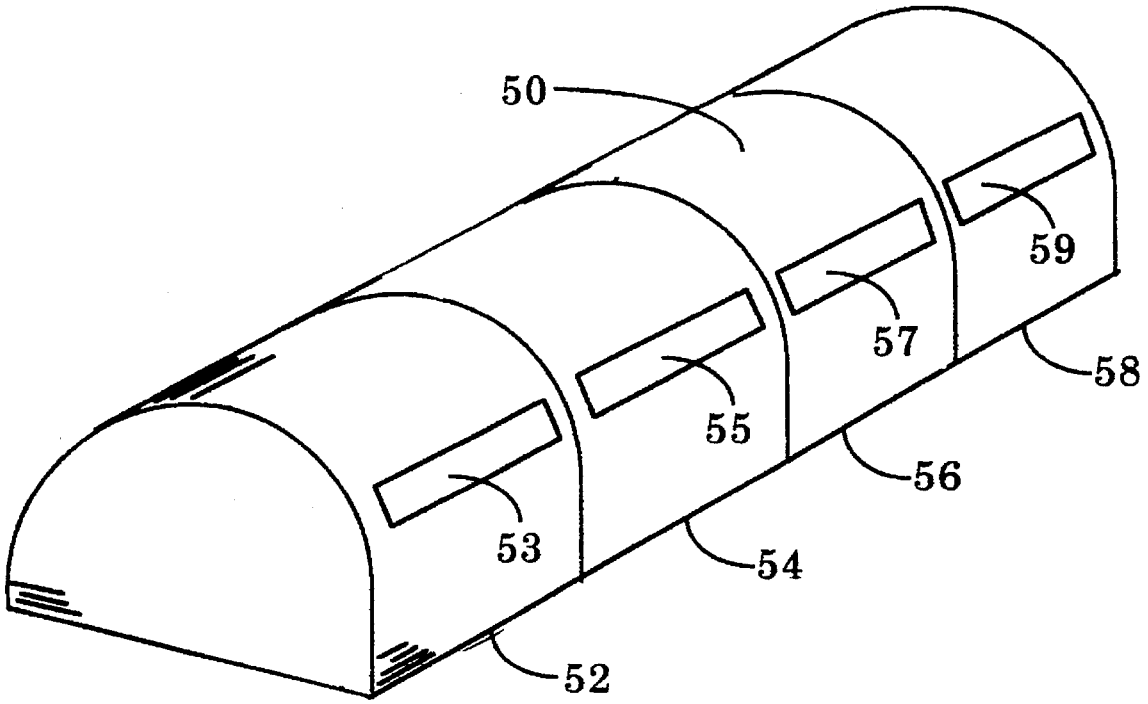
FIG. 11 is a perspective view of a eighth embodiment of the present invention, wherein a plurality of dispensing apparatus are housed within a refillable unit.

The embodiment of FIG. 11 comprises a plurality of discrete dispensers 52, 54, 56 and 58 joined together to form a single unit 50. Each of the dispensers 52, 54, 56 and 58 include an opening 53, 55, 57 and 59 through which the articles can be dispensed. A plurality of different articles, such as bandages, gauze, antiseptic wipes, can be accommodated in a single unit 50. Moreover, the unit 50 can be a permanent dispenser having a flip open top (not shown) for refilling each dispenser with a refill package of the desired article to be dispensed.

Figure 12:
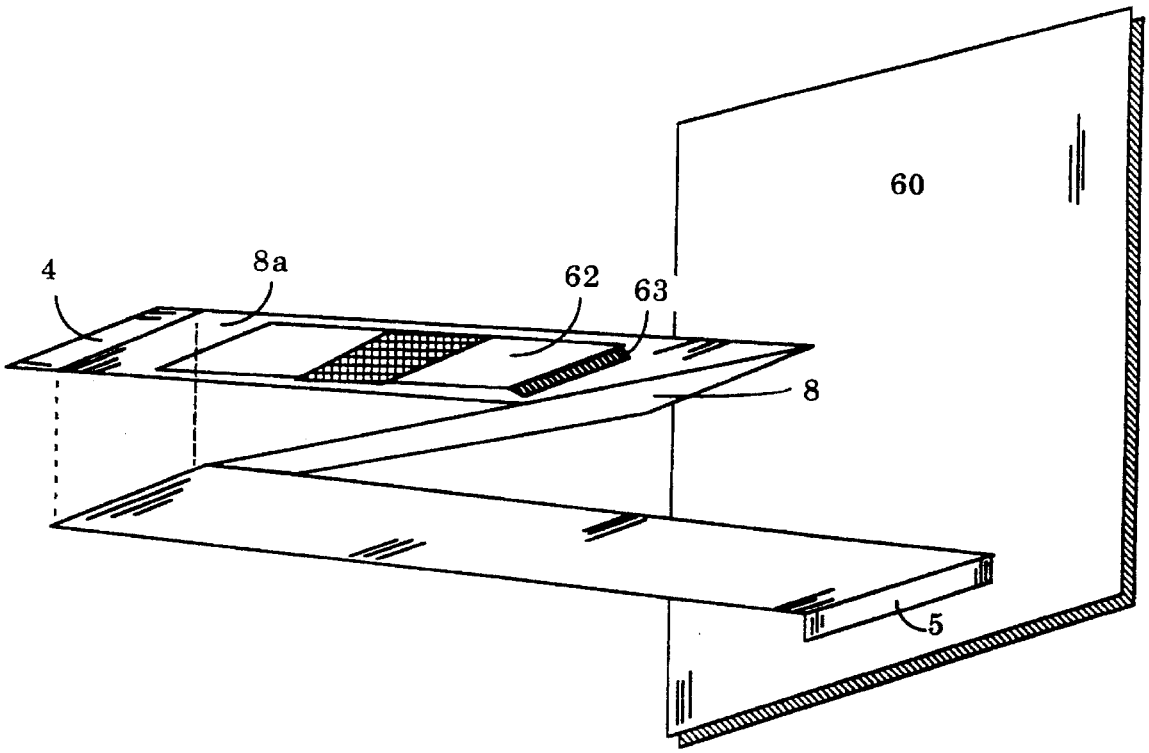
FIG. 12 is a perspective view of another embodiment of the invention, wherein the wrapped article is a bandage strip.

As shown in the embodiment of FIG. 12, the elongated tab 5 of the wrapper can be attached directly to a discrete surface 60, without the need for a platform or package, as described in previous embodiments.

The embodiment of FIG. 12 also illustrates the ability of a user to remove and apply, for example, a bandage 62, with one hand. As shown in FIG. 12, the bandage 62 is adhered directly to an inside surface 8*a* of wrapper 8. One end 63 of bandage 62 can be free from adhesive so that the user can grasp end 63 and remove bandage 62 from surface 8*a*. During dispensing, like in the previous embodiments, the user grasps pull-tab 4 breaking the seal between the ends of wrapper 8 to expose bandage 62. Next the user grasps end 63 and removes bandage 62 from wrapper 8. Still grasping end 63, the user can apply bandage 62 to a wound in a single, fluid, one-handed operation.

Figure 13:
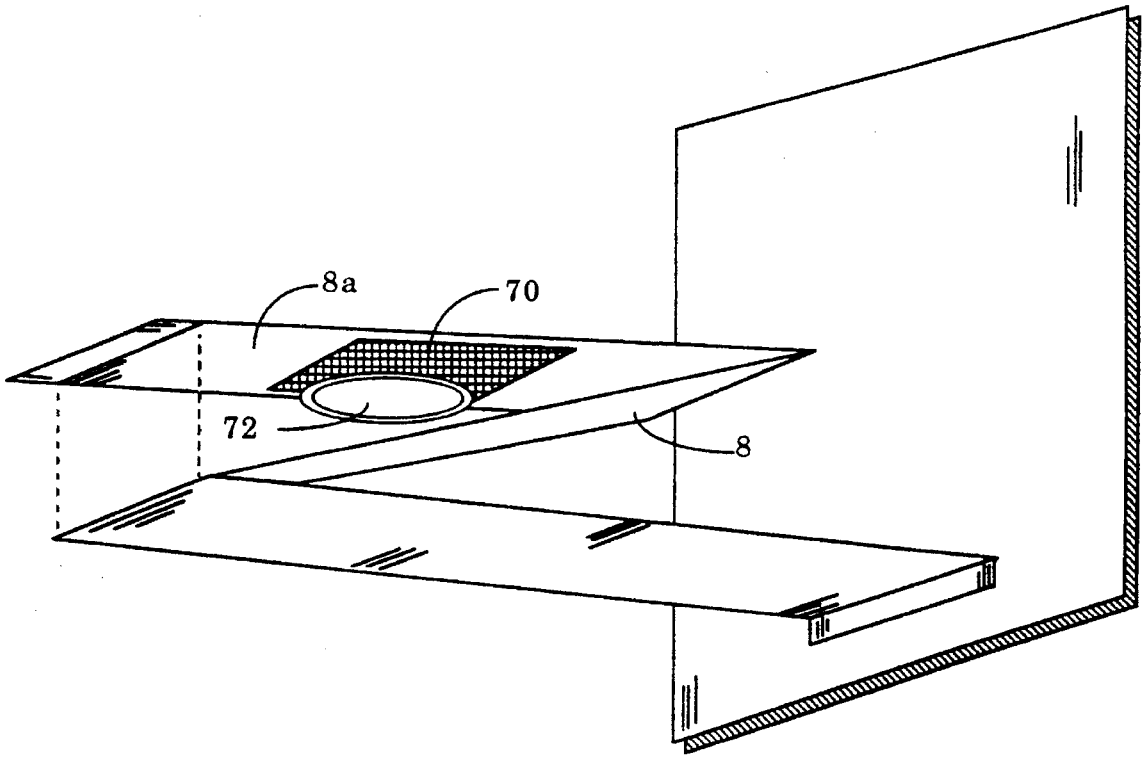
FIG. 13 is a perspective view of a tenth embodiment of the invention, wherein the wrapped article is a lubricated condom.

FIG. 13 illustrates an embodiment of the invention, wherein the wrapper 8 includes an absorbent material 70, for example, gauze, disposed on interior surface 8*a* of wrapper 8. When the article to be dispensed is lubricated, for example, a condom 72, the material 70 covers the lubricated article and absorbs excess lubricant before and after dispensing.

Next, the steps in manufacturing the dispensing apparatus of the present invention will be described. First, an elongated piece of material forming the wrapper 8, pull-tab 4 and elongated tab 5 is provided. An article to be dispensed is then positioned on the appropriate area of the wrapper. To aid in placement of the article on the wrapper an adhesive or tacky surface can be provided. The wrapper ends are sealed together leaving adequate lengths of material free to form the pull-tab and elongated tab at the ends of the wrapper. Next, the free end of the elongated tab, i.e. the end not attached to the wrapper portion is attached to a surface, such as a package. Different means for attaching the ends of the elongated tabs are contemplated. As disclosed in the first embodiment of FIGS. 1 and 2, elongated tab 5 can be attached via a fastener 6. With reference to the embodiment of FIGS. 7 and 8, a layer of hot glue is placed in the bottom of the package and the elongated tabs are placed in the hot glue and remain adhered to the package bottom after the glue has dried.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dispensing apparatus comprising:

at least one package having a bottom and at least one opening;

a plurality of wrapped articles disposed within said package, each of said wrapped articles having a first and second end;

a plurality of pull-tabs, one of each of said pull-tabs being attached to the first end of each of said wrapped articles; and a plurality of elongated tabs, each of said elongated tabs having opposed ends, one end of each of said elongated tabs being attached to the second end of one of each of said wrapped articles and the other end of each of said plurality of elongated tabs being attached to the bottom of said package, wherein when the pull-tab is pulled outwardly the respective article unwraps and is dispensed through the opening of said package.

2. The dispensing apparatus of claim 1, wherein each of said wrapped articles is wrapped in a wrapper, said pull-tab being attached and extending from one end of the wrapper and the respective elongated tab being attached to another end of the wrapper, the wrapper detaching from the respective elongated tab after the article is dispensed.

3. The dispensing apparatus of claim 2, wherein the wrapper is joined to the respective elongated tab via a perforation.

4. The dispensing apparatus of claim 1, further comprising a platform extending from and partially along the bottom of said package, wherein the other end of some of said elongated tabs are attached to said platform and the other end of some of said elongated tabs are attached to said bottom of said package.

5. The dispensing apparatus of claim 4, wherein said plurality of wrapped articles comprise different sized bandages.

6. The dispensing apparatus of claim 5, wherein the pull-tabs are color-coded to indicate the different sized bandages.

7. The dispensing apparatus of claim 3, wherein each of said plurality of wrapped articles is a bandage attached directly to an inner surface of said wrapper, such that when the article is unwrapped and dispensed through the opening of said package the bandage remains adhered to the wrapper.

8. The dispensing apparatus of claim 7, wherein the bandage includes a free end which a user may grasp to remove the bandage from the wrapper.

9. The dispensing apparatus of claim 3, wherein each of said plurality of wrapped articles includes an ointment and the wrapper includes an absorbent material to absorb any excess ointment.

10. The dispensing apparatus of claim 3, wherein said plurality of wrapped articles are lubricated condoms.

11. The dispensing apparatus of claim 1, comprising a plurality of discrete joined packages, each of said packages dispensing a different article.

12. The dispensing apparatus of claim 1, further comprising a dispenser for receiving said at least one package.

13. The dispensing apparatus of claim 12, wherein said at least one package is a disposable package removably disposed in said dispenser.

14. The dispensing apparatus of claim 13, wherein said dispenser includes mounting means for mounting the dispenser on a surface.

15. The dispensing apparatus of claim 13, wherein said dispenser includes an opening through which said plurality of pull-tabs extend outwardly.

16. The dispensing apparatus of claim 1, wherein said at least one package is wedged-shaped.

17. The dispensing apparatus of claim 1, wherein said plurality of pull-tabs extend outwardly through said at least one opening.

18. A method of forming a dispensing apparatus, comprising the steps of:

providing a plurality of wrappers, each of said wrappers having a first end and a second end:

locating at least one article in each of said plurality of wrappers;

folding a portion of each of said wrappers to enclose said at least one article, wherein the first end of each of said articles includes a pull-tab attached thereto, and the second end of each of said articles is elongated to form an elongated tab;

sealing said wrapper to enclose said article; and attaching said elongated tab to a surface, wherein when said pull-tab is pulled the wrapper is unwrapped, said article is dispensed and said elongated tab remains attached to said surface.

19. The method of claim 18, wherein said surface is a package having a bottom and said step of attaching said elongated tab comprises applying a layer of adhesive to the bottom of said package, inserting said plurality of articles into said package, and adhering said elongated tabs to said adhesive.

* * * * *